US007140799B2

(12) United States Patent
Kobayashi

(10) Patent No.: US 7,140,799 B2
(45) Date of Patent: Nov. 28, 2006

(54) WRITING IMPLEMENT

(75) Inventor: Takeshi Kobayashi, Yokohama (JP)

(73) Assignee: Mitsubishi Pencil KabushikiKaisha, Tokyo (JP)

( * ) Notice: Subject to any disclaimer, the term of this patent is extended or adjusted under 35 U.S.C. 154(b) by 0 days.

(21) Appl. No.: 10/569,283

(22) PCT Filed: Jul. 21, 2004

(86) PCT No.: PCT/JP2004/010326

§ 371 (c)(1),
(2), (4) Date: Mar. 10, 2006

(87) PCT Pub. No.: WO2005/018952

PCT Pub. Date: Mar. 3, 2005

(65) Prior Publication Data

US 2006/0182489 A1 Aug. 17, 2006

(30) Foreign Application Priority Data

Aug. 25, 2003 (JP) ..... 2003-300225

(51) Int. Cl.
*B43M 11/02* (2006.01)

(52) U.S. Cl. ..... 401/219; 401/220; 401/209; 401/216; 401/214; 401/208

(58) Field of Classification Search ..... 401/219, 401/220, 208–216, 205, 206
See application file for complete search history.

(56) References Cited

U.S. PATENT DOCUMENTS 5,709,493 A * 1/1998 Kobayashi et al. ..... 401/219
5,711,626 A * 1/1998 Kobayashi et al. ..... 401/219
5,915,871 A * 6/1999 Kobayashi et al. ..... 401/213
5,929,135 A * 7/1999 Wasai et al. ..... 401/219
6,536,969 B1 * 3/2003 Nishitani ..... 401/219

FOREIGN PATENT DOCUMENTS

| | | | |
|---|---|---|---|
| JP | 57-136780 | U | 8/1982 |
| JP | 4-52067 | Y2 | 12/1992 |
| JP | 3197422 | B2 | 6/2001 |
| JP | 3275217 | B2 | 2/2002 |

* cited by examiner

*Primary Examiner*—Khoa D. Huynh
(74) *Attorney, Agent, or Firm*—Kubovcik & Kubovcik

(57) ABSTRACT

A writing implement, wherein elements forming a reverse flow prevention mechanism are formed in rather simple shapes and assembly process for the reverse flow prevention mechanism is rather simplified. The reverse flow prevention mechanism (19) comprises a valve chamber (54*b*), an inflow port (55) opened to the ink storage part (16) side of the valve chamber (54*b*), an outflow port (56) opened to the writing tip (17) side of the valve chamber (54*b*), a valve element (57) stored in the valve chamber (54*b*), a restricting body (58) stored in the valve chamber (54*b*) at a position on the outflow port (56) side of the valve element (57), and a valve seat (54*c*) formed around the inflow port (55). When the writing tip (17) is faced upward, the inflow port (55) is closed by the valve element (57), and when faced downward, the valve element (57) is allowed to touch the restricting body (58) and does not reach the outflow port (56).

1 Claim, 9 Drawing Sheets

WRITING IMPLEMENT

This application is a 371 of international application PCT/JP2004/010326, which claims priority based on Japanese patent application No. 2003-300225 filed Aug. 25, 2003, which is incorporated herein by reference.

TECHNICAL FIELD

The present invention relates to a writing implement, more particularly to a writing implement having a reverse flow prevention mechanism for ink.

BACKGROUND ART

Conventionally, as a writing implement having a reverse flow prevention mechanism for ink, for example, a ballpoint pen disclosed in JP 04-52067 Y or JP 3197422 B is known. Hereinafter, explanation is made referring to both FIG. 8 illustrating the former prior art and FIG. 9 illustrating the latter one. Here, the figures referred to in the following explanation are all described in these FIGS. 8 and 9.

A ballpoint pen 100 disclosed in JP 04-52067 Y, as illustrated in FIG. 8, comprises an ink storage tube 110, a joint 120 fixed to a front end of the ink storage tube 110, and a tip 130 fixed to a front end of the joint 120.

In a center of the joint 120 is provided a valve chamber 121. In front of the valve chamber 121 is provided a tip fixing hole 122 penetrating from the valve chamber 121 to the front end of the joint 120. In rear of the valve chamber 121 is provided an ink storage tube fixing hole 123 penetrating from the valve chamber 121 to a rear end of the joint 120.

At a rear part of the valve chamber 121 is provided a valve seat 124. On an inner surface of a front part of the valve chamber is provided a plurality of protrusions 125 protruding inward of the valve chamber 121.

The joint 120 is molded integrally of elastically deformable resin composition.

In the valve chamber 121 is stored a spherical valve element 126. The valve element 126 can move in the valve chamber 121 by its own weight and cannot slip out of the valve chamber 121.

A rear end part of the tip 130 is pressed into and fixed to the tip fixing hole 122. A front end of the ink storage tube 110 is pressed into and fixed to the ink storage tube fixing hole 123.

When the tip 130 is faced upward, the valve element 126 falls toward the ink storage tube 110 by its own weight and touches a whole circumference of the valve seat 124. Thereby, reverse flow of ink is prevented.

On the other hand, when the tip 130 is faced downward, the valve element 126 falls toward the tip 130 by its own weight and is caught by the protrusions 125. Thereby, the ink is supplied to the tip 130 through gaps between the protrusions 125.

On the other hand, a ballpoint pen 100 disclosed in JP 3197422 B, as illustrated in FIG. 9, comprises an ink storage tube 110, a joint 120 fixed to a front end of the ink storage tube 110, and a tip 130 fixed to a front end of the joint 120.

In a center of the joint 120 is provided a valve chamber 121. In front of the valve chamber 121 is provided a tip fixing hole 122 penetrating from the valve chamber 121 to the front end of the joint. In rear of the valve chamber 121 is provided a guiding hole 127 penetrating from the valve chamber 121 to a rear end of the joint.

At a rear part of the valve chamber 121 is provided a valve seat 124.

In the valve chamber 121 is stored a spherical valve element 126. The valve element 126 can move in the valve chamber 121 by its own weight and cannot slip out of the valve chamber 121.

A rear end of the tip 130 is pressed into and fixed to the tip fixing hole 122.

A rear end of the joint 120 is pressed into and fixed to a front end of the ink storage tube 110.

An intervening piece 140 is inserted forcibly and fixed between the valve element 126 and the rear end of the tip 130. At a rear end of the intervening piece 140 is provided ink grooves 141. Ink can pass through the ink grooves 141 when the valve element 126 touches the rear end of the intervening piece 140.

In the tip 130 is stored a spring 150. A rear end of the spring 150 touches a front end of the intervening piece 140. A front end of the spring 150 touches a rear end of a ball 131 held by a front end of the tip 130.

When writing is not performed, the ball 131 is pressed onto an inner surface of a bent portion by being pushed by the spring 150.

When the tip 130 is faced upward, the valve element 126 falls toward the ink storage tube 110 by its own weight and touches a whole circumference of the valve seat 124. Thereby, reverse flow of the ink is prevented.

On the other hand, when the tip 130 is faced downward, the valve element 126 falls toward the tip 130 by its own weight and touches the rear end of the intervening piece 140. Under this condition, the ink is supplied to the tip 130 through the ink grooves 141. Moreover, though writing is not performed, a direct flow of the ink is prevented since the ball 131 is pressed onto the inner surface of the bent portion by being pushed by the spring 150.

However, as disclosed in JP 04-52067 Y, when the protrusions are provided on the inner surface of the valve chamber, a mold structure for molding becomes rather complex since the protrusions make undercuts. Thereby, manufacturing cost for a whole writing implement becomes rather expensive. Moreover, since the protrusions make undercuts, the size of each protrusion must be made as small as possible. Then, passages for the ink flow may not be sufficiently secured depending upon a diameter of the ball or a kind of the ink.

Moreover, as disclosed in JP 319422 B, when the intervening piece is fixed between the valve element and the rear end of the tip, a shape of the intervening piece becomes complex and highly-developed manufacturing technology is necessary for a process of inserting the intervening piece into the joint with the intervening piece correctly directed. Namely, very highly-developed manufacturing technology is necessary for a process of inserting the intervening piece to be located in a predetermined position in the joint with the ink grooves of the intervening piece being directed backward. Thus, manufacturing cost for a whole writing implement becomes expensive.

Then, the first problem to be solved by the present invention is to provide a writing implement wherein elements (a valve chamber, etc.) forming a reverse flow prevention mechanism are formed in rather simple shapes and assembly process for the reverse flow prevention mechanism is rather simplified, thereby contributing to reduction of the manufacturing cost.

Moreover, the second problem to be solved by the present invention is, in addition to the first problem, to provide the writing implement wherein the assembly process for the reverse flow prevention mechanism is more simplified.

DISCLOSURE OF INVENTION

In view of the first problem, the present invention is a writing implement comprising an ink storage part storing ink, a writing tip applying the ink, an ink guiding hole connecting the ink storage part and the writing tip, and a reverse flow prevention mechanism provided in a midway of the ink guiding hole and preventing reverse flow of the ink; the reverse flow prevention mechanism comprising a valve chamber consisting of a part of the ink guiding hole, an inflow port opened to the ink storage part side of the valve chamber and having a smaller inner diameter than that of the valve chamber, an outflow port opened to the writing tip side of the valve chamber and having a smaller inner diameter than that of the valve chamber, a valve element stored in the valve chamber and being movable in the valve chamber by its own weight, a restricting body being stored in the valve chamber at a position on the outflow port side of the valve element, being formed not to touch the writing tip, and being formed in a shape not to interrupt an ink flow in the valve chamber and not to close the outflow port, and a valve seat provided around the inflow port; the inflow port being closed by the valve element falling toward the inflow port by its own weight to touch the valve seat when the writing tip is faced upward; the inflow port being opened by the valve element falling toward the outflow port by its own weight to depart from the valve seat and touching the restricting body not to reach the outflow port when the writing tip is faced downward.

The "ink storage part" is a part in which the ink is stored.

For example, in case of a writing implement comprising a cylindrical ink storage tube in which ink is stored, an inner space of the ink storage tube works as the ink storage part.

The "writing tip" is a part for applying the ink. Namely, the writing tip is a part touching a surface to be written.

For example, in case that the writing implement is a ballpoint pen, a ball held capable of freely rotating by a front end of a tip works as the writing tip.

The "ink guiding hole" is a hole that connects the ink storage part and the writing tip.

For example, in case of a writing implement in which a joint is fixed to a front end of an ink storage tube and a tip is fixed to a front end of the joint, i.e., a writing implement in which the ink storage tube and the tip are fixed through the joint, an integrated hole consisting of a penetrating hole in the joint and a back hole in the tip works as the ink guiding hole.

Moreover, in case of a writing implement in which a tip is directly fixed to a front end of an ink storage tube, a back hole in the tip works as the ink guiding hole.

The "reverse flow prevention mechanism" is provided for preventing reverse flow of the ink.

The reverse flow prevention mechanism is provided in a midway of the ink guiding hole. Therefore, the reverse flow prevention mechanism may be provided in a midway of the penetrating hole (i.e., in the joint) or may be provided in a midway of the back hole (i.e., in the tip).

The reverse flow prevention mechanism comprises the "valve chamber," the "inflow port," the "outflow port," the "valve element," the "restricting body" and the "valve seat."

At an ink storage tube side of the valve chamber is opened the inflow port. At a writing tip side of the valve chamber is opened the outflow port. The inner diameters of both the inflow port and the outflow port are smaller than that of the valve chamber. Then, the ink flows into the valve chamber through the inflow port, and the ink in the valve chamber flows out through the outflow port.

In the valve chamber are stored the valve element and the restricting body. The valve element is always at a position on the inflow port side of the restricting body. The restricting body is always at a position on the outflow port side of the valve element.

The valve element is made to be movable in the valve chamber by its own weight. Though the valve element is made to be movable in the valve chamber, it never comes to the outflow port side of the restricting body.

The restricting body is so formed as not to touch the writing tip. For example, in case that the writing implement is a ballpoint pen, the restricting body may touch a holder of the writing tip, but is so formed as not to touch the ball.

The restricting body is so formed in a shape as not to interrupt the ink flow in the valve chamber and not to close the outflow port. In case that the valve chamber is a round-shaped hole and so is the outflow port, the restricting body is formed, for example, as a rectangular plate-shape whose shorter sides are smaller than the inner diameter of the valve chamber and larger than the inner diameter of the outflow port and whose longer sides are larger than the inner diameter of the valve chamber. Thus, the restricting body may be made not to interrupt the ink flow in the valve chamber and not to close the outflow port.

The restricting body is not limited to the rectangular shape and may be formed in any desired shape unless it interrupts the ink flow in the valve chamber and closes the outflow port.

The valve element may be formed, for example, in a spherical shape or in a wedge shape.

The valve seat is provided around the inflow port and is so formed that it can be touched by the valve element. In case that the valve element is spherical shaped, the valve seat may be formed, for example, in a tapered shape or in a concaved spherical shape whose inner diameter gradually becomes smaller toward the ink storage part side.

When the writing tip is faced upward, the valve element falls toward the inflow port by its own weight. Then, the valve element touches the valve seat and closes the inflow port. Thereby, the reverse flow of the ink is prevented.

On the other hand, when the writing tip is faced downward, the valve element falls toward the outflow port by its own weight. Then, the valve element departs from the valve seat and the inflow port is opened. At the same time, since the valve element touches the restricting body, it does not reach the outflow port. Thereby, since the ink can flow into the valve chamber through the inflow port and the outflow port is not closed by the valve element, the ink in the valve chamber can flow out through the outflow port to be supplied to the writing tip.

According to the invention, the movement of the valve element toward the outflow port is prevented by the restricting body. Thereby, it is not necessary to provide any protrusion on the inner surface of the valve chamber. Moreover, the restricting body may be formed in any desired shape, e.g., a rectangular shape, etc., unless it interrupts the ink flow in the valve chamber and closes the outflow port. Furthermore, since the restricting body should only be so stored in the valve chamber as to be at a position on the outflow port side of the valve element, does not touch the writing tip and is not formed as a member for either pushing or fixing the spring, there is no need for a minute positioning. Therefore, the elements (the valve chamber, etc.) forming the reverse flow prevention mechanism can be formed in rather simple shapes. Moreover, the assembly process for the reverse flow prevention mechanism can be rather simplified, thereby contributing to reduction of the manufacturing cost.

In view of the second problem, the present invention is, in addition to the characteristics as described above, characterized in that the restricting body is movable in the valve chamber by its own weight.

According to the invention, since the restricting body is also movable in the valve chamber as well as the valve element, there is no need for a positioning of the restricting body in the valve chamber at all. Namely, the restricting body should only be simply thrown into the valve chamber. Therefore, the assembly process for the reverse flow prevention mechanism can be more simplified.

BEST MODE FOR CARRYING OUT THE INVENTION

Hereinafter, explanation is made for a ballpoint pen as a writing implement according to a present embodiment.

Figure 1:
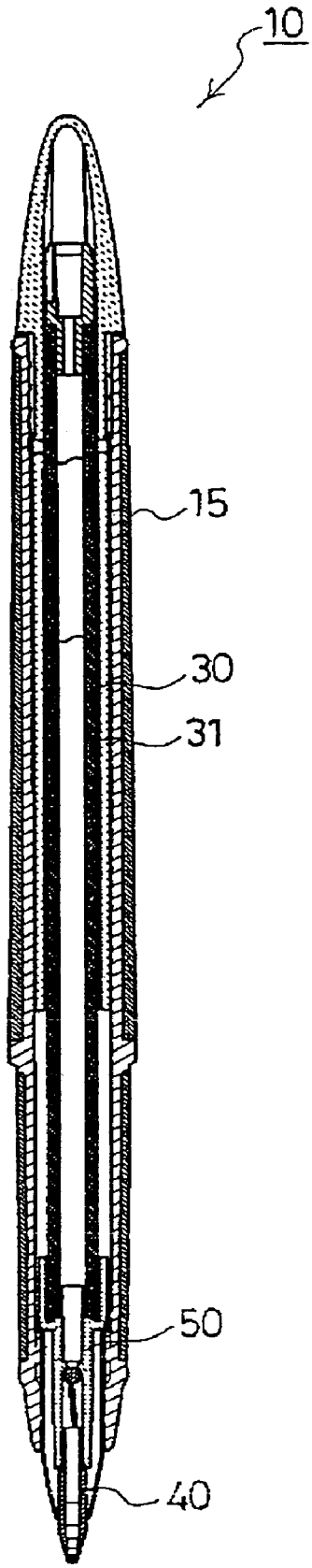
[FIG. 1] a side sectional view of a ballpoint pen as a writing implement according to an embodiment of the present invention.
Figure 2:
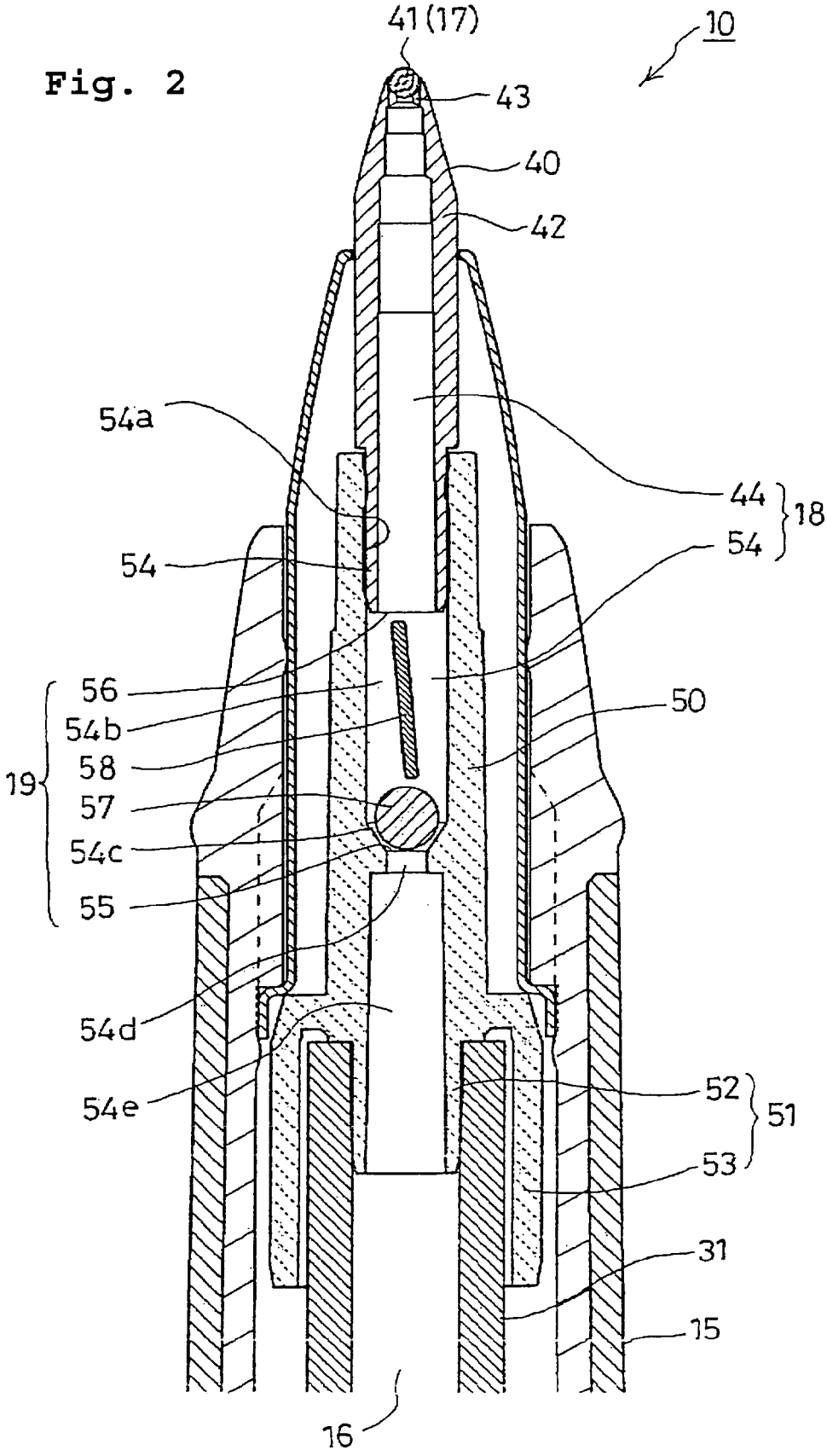
[FIG. 2] a side sectional view of an essential part of a ballpoint pen as a writing implement according to an embodiment of the present invention.
Figure 3:
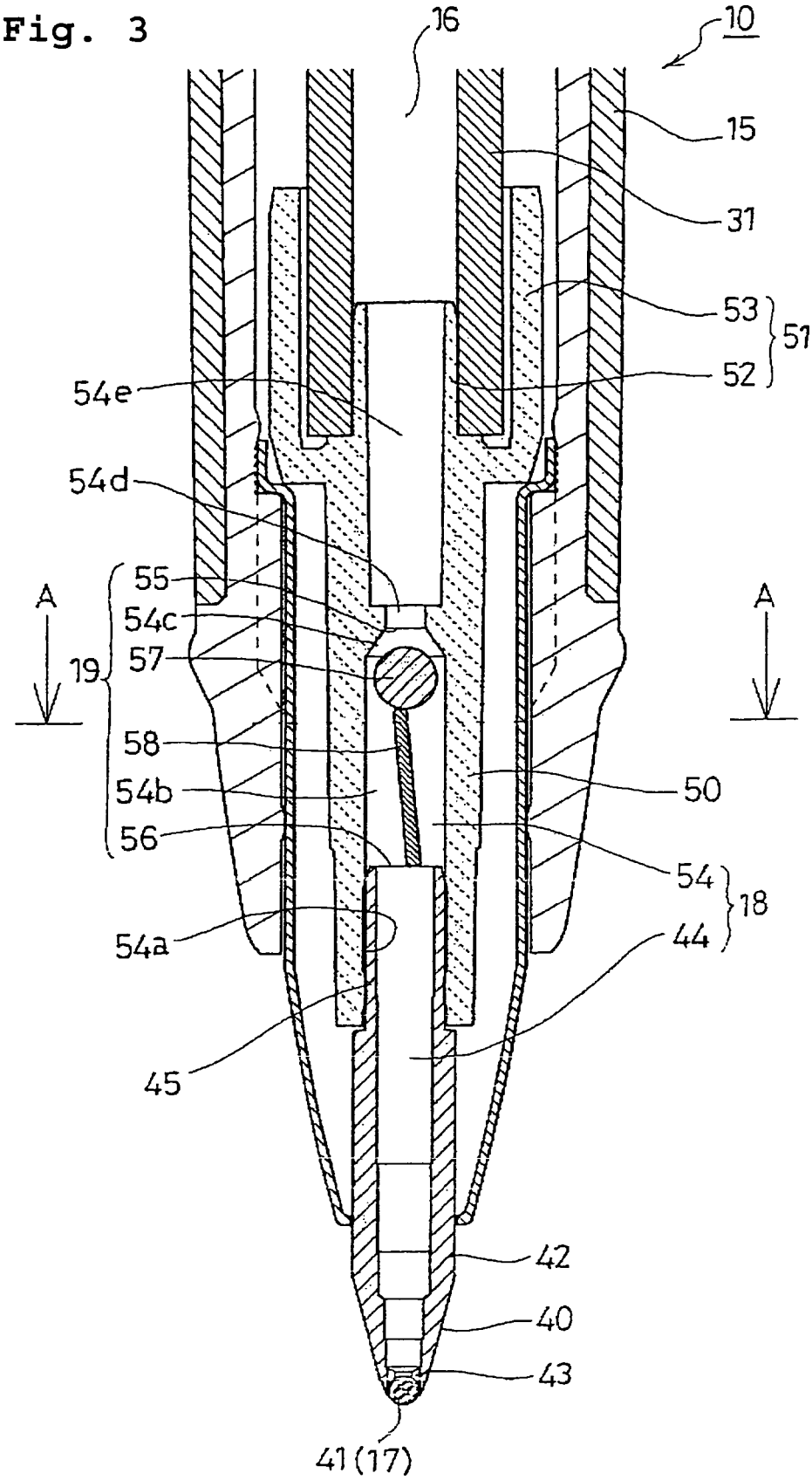
[FIG. 3] a side sectional view of an essential part of a ballpoint pen as a writing implement according to an embodiment of the present invention (with a tip faced downward).
Figure 4:
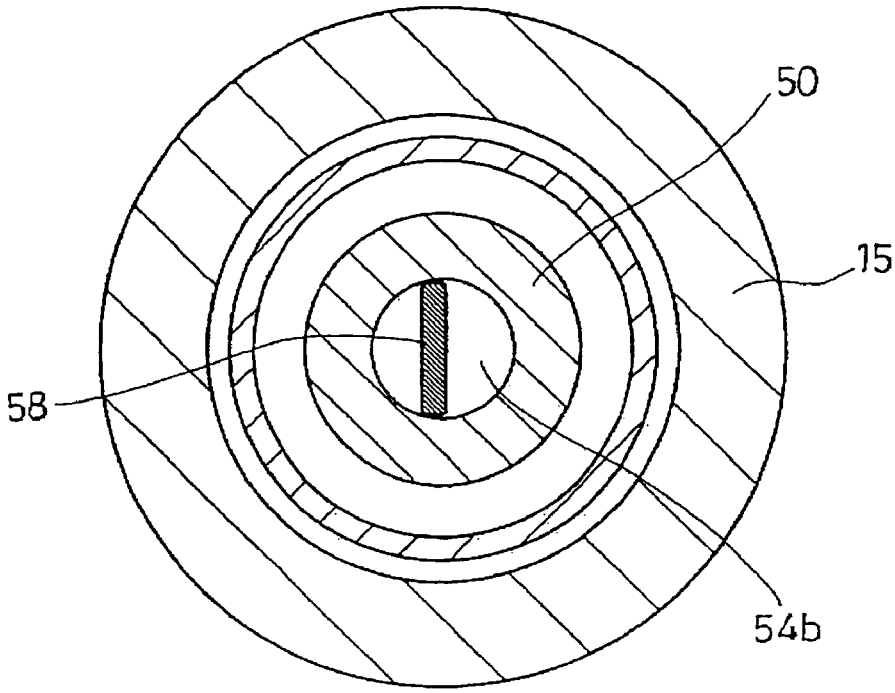
[FIG. 4] a sectional view along the A—A line in FIG. 3.

FIG. 1 is a side sectional view of a ballpoint pen 10, FIG. 2 is a side sectional view of an essential part of the ballpoint pen 10, FIG. 3 is a side sectional view of the essential part of the ballpoint pen 10 (with a tip 40 faced downward), FIG. 4 is a sectional view along the A—A line in FIG. 3, and FIGS. 5 to 7 are sectional views of modified embodiments of a restricting body 58.

The ballpoint pen 10 as a writing implement according to the present embodiment comprises a cylindrical shaft tube 15 and a refill 30 assembled inside the shaft tube 15.

The refill 30 comprises a cylindrical ink storage tube 31, a joint 50 fixed to a front end of the ink storage tube 31 and a tip 40 fixed to a front end of the joint 50.

The ink storage tube 31 is provided for storing ink. Inside the ink storage tube 31 is stored the ink. Namely, in the present embodiment, the inside of the ink storage tube 31 works as an ink storage part 16.

The joint 50 is provided for connecting the ink storage tube 31 and the tip 40. Namely, the ink storage tube 31 and the tip 40 are fixed through the joint 50.

At a rear end of the joint 50 is provided a storage tube fixing part 51 for fixing the ink storage tube 31. The storage tube fixing part 51 comprises a cylindrical inner tubular part 52 and a cylindrical outer tubular part 53 that shares the same centerline with the inner tubular part 52 and has a larger diameter than that of the inner tubular part 52. An outer diameter of the inner tubular part 52 is slightly larger than an inner diameter of the ink storage tube 31, and an inner diameter of the outer tubular part 53 is slightly smaller than an outer diameter of the ink storage tube 31. Then, a front end part of the ink storage tube 31 is pressed into a gap between the inner tubular tube 52 and the outer tubular tube 53. Thus, the joint 50 is fixed to the front end of the ink storage tube 31.

Moreover, in the joint 50 is provided a penetrating hole 54 penetrating from a front end to a rear end thereof. The penetrating hole 54 consists of a tip fixing hole 54*a*, a valve chamber 54*b*, a valve seat 54*c*, a lesser guiding hole 54*d* and a greater guiding hole 54*e*, in an order from its front end. Namely, in an order from the front end of the joint 50, the tip fixing hole 54*a*, the valve chamber 54*b*, the valve seat 54*c*, the lesser guiding hole 54*d* and the greater guiding hole 54*e* are integrated to form the penetrating hole 54. The tip fixing hole 54*a* and the valve chamber 54*b* are formed as a round-shaped hole of an approximately equal inner diameter. Moreover, the valve seat 54*c* is formed in a tapered shape whose inner diameter gradually becomes smaller toward the rear end. Moreover, the lesser guiding hole 54*d* is formed as a round-shaped hole of the smallest inner diameter in the penetrating hole 54. Moreover, the greater guiding hole 54*e* is formed as a round-shaped hole of a larger inner diameter than that of the lesser guiding hole 54*d*. Moreover, the greater guiding hole 54*e* is connected to the inside of the ink storage tube 31 (i.e., the ink storage part 16).

The tip 40 comprises a ball 41 as a writing tip 17 and a holder 42 for holding the ball 41. The holder 42 has a ball house 43 at its front end in which the ball 41 is stored, and also has a back hole 44 that penetrates from its rear end to the ball house 43. After the ball 41 is inserted in the ball house 43, the front end of the holder 42 is bent to hold the ball 41 capable of freely rotating at the front end. Moreover, an inner diameter of the back hole 44 becomes smaller stepwise from its rear end to its front end.

Moreover, around the rear end part of the holder 42 is provided a diminished diameter part 45 of a smaller outer diameter than that of a middle part of the holder 42. Then, the diminished diameter part 45 is pressed into the tip fixing hole 54*a* of the joint 50. In this way, the tip 40 is fixed to the front end of the joint 50.

Moreover, the penetrating hole 54 of the joint 50 and the back hole 44 of the holder 42 are integrated to introduce the ink from the ink storage part 16 to the ball 41 as the writing tip 17. Namely, in the present embodiment, an integrated hole consisting of the penetrating hole 54 and the back hole 44 works as an ink guiding hole 18 connecting the ink storage part 16 and the writing tip 17.

In a midway of the ink guiding hole 18 is provided a reverse flow prevention mechanism 19. The reverse flow prevention mechanism 19 is provided for preventing reverse flow of the ink. The reverse flow prevention mechanism 19 consists of the valve chamber 54*b*, an inflow port 55, an outflow port 56, a valve element 57, a restricting body 58 and the valve seat 54*c*. The valve chamber 54*b* is located in a middle of the joint 50 and consists of a part of the penetrating hole 54 (i.e., of a part of the ink guiding hole 18). The inflow port 55 is opened to the ink storage part 16 side of the valve chamber 54*b*, and the outflow port 56 is opened to the writing tip 17 side of the valve chamber 54*b*. In the present embodiment, an opening at a front end of the lesser guiding hole 54*d* works as the inflow port 55, and an opening at a rear end of the back hole 44 works as the outflow port 56. Both the inflow port 55 and the outflow port 56 are of a smaller inner diameter than that of the valve chamber 54*b*. Then, the ink flows into the valve chamber 54*b* through the inflow port 55, and the ink in the valve chamber 54*b* flows out through the outflow port 56. Moreover, since the opening at the front end of the lesser guiding hole 54*d* works as the inflow port 55, the valve seat 54*c* is provided circularly around the inflow port 55.

Moreover, in the valve chamber 54*b* is stored the valve element 57 and the restricting body 58. The valve element 57 is stored at a position on the inflow port 55 side in the valve chamber 54*b*, and the restricting body 58 is stored at a position on the outflow port 56 side in the valve chamber 54*b*.

The valve element 57 is made of stainless steel in a spherical shape. The diameter of the valve element 57 is smaller than the inner diameter of the valve chamber 54*b* and larger than the inner diameter of the inflow port 55. Thus, the valve element 57 is made to be movable in the valve chamber 54*b* by its own weight. Moreover, the valve element 57 never slips out of the valve chamber 54*b* through the inflow port 55.

The restricting body 58 is made of stainless steel in a rectangular plate-shape. Shorter sides of the restricting body 58 are smaller than the inner diameter of the valve chamber 54*b* and longer than the inner diameter of the outflow port 56. Moreover, longer sides of the restricting body 58 are larger than the inner diameter of the valve chamber 54*b*. Thus, the restricting body 58 is made to be movable in the valve chamber 54*b* by its own weight, does not interrupt the ink flow in the valve chamber 54*b* and does not close the outflow port 56. Moreover, the restricting body 58 never slips out of the valve chamber 54*b* through the outflow port 56. Therefore, the restricting body 58 never comes into the holder 42 of the tip 40, and never touches the ball 41 as the writing tip 17.

Moreover, though both the valve element 57 and the restricting body 58 are made to be movable in the valve chamber 54*b*, the valve element 57 is always at a position on the inflow port 55 side of the restricting body 58 and the restricting body 58 is always at a position on the outflow port 56 side of the valve element 57.

Then, when the ball 41 as the writing tip 17 is faced upward, the valve element 57 falls toward the inflow port 55 by its own weight and touches a whole circumference of the valve seat 54*c* to close the inflow port 55. The reverse flow of the ink is prevented thereby.

On the other hand, when the ball 41 as the writing tip 17 is faced downward, the valve element 57 falls toward the outflow port 56 by its own weight and departs from the valve seat 54*c* to open the inflow port 55. At the same time, the restricting body 58 falls toward the outflow port 56 by its own weight and touches the rear end of the holder 42 of the tip 40, and the valve element 57 touches the restricting body 58 to be prevented from reaching the outflow port 56. Thereby, since the ink flows into the valve chamber 54*b* through the inflow port 55 and the outflow port 56 is not closed by the valve element 57, the ink in the valve chamber 54*b* flows out through the outflow port 56 and is supplied to the ball 41 as the writing tip 17. At this time, though the valve element 57 departs from the valve seat 54*c*, it is prevented by the restricting body 58 from moving toward the outflow port 56 and stays at a position relatively near to the valve seat 54*c*. Thus, when the ball 41 as the writing tip 17 is turned from downward to upward, a time necessary for the valve element 57 to touch the valve seat 54*c* is relatively short.

Next, a brief explanation is made to an assembly process of the reverse flow prevention mechanism 19 among the assembly process of the ballpoint pen 10 as the writing implement according to the present embodiment.

First, the valve element 57 is thrown into the valve chamber 54*b* from the front end of the joint 50, and then the restricting body 58 is thrown into the valve chamber 54*b* from the front end of the joint 50. After that, the diminished diameter part 45 of the holder 42 of the tip 40 is pressed into the tip fixing hole 54*a* of the joint 50 and thereby the tip 40 is fixed to the front end of the joint 50.

As explained above, in the present embodiment, the valve element 57 is prevented by the restricting body 58 from moving toward the outflow port 56. Thereby, it is not necessary to provide any protrusions on the inner surface of the valve chamber 54*b*.

Moreover, the restricting body 58 is formed in a rectangular plate-shape. Thereby, it is very easy to manufacture the restricting body 58.

Moreover, in the present embodiment, the restricting body 58 is made to be movable in the valve chamber 54*b*, does not touch the ball 41 as the writing tip 17, and does not work as a member for pushing or fixing a spring. Thereby, when the restricting body 58 is stored in the valve chamber 54*b*, there is no need to insert the restricting body 58 forcibly or no need for a minute positioning.

Thus, in the present embodiment, the elements (the valve chamber 54*b*, etc.) forming the reverse flow prevention mechanism 19 can be formed in relatively simple shapes. Moreover, the assembly process for the reverse flow prevention mechanism 19 can be rather simplified, thereby contributing to reduction of the manufacturing cost.

Moreover, in the present embodiment, the shorter sides of the restricting body 58 are larger than the inner diameter of the back hole 44. Thus, since the restricting body 58 does not come into the holder 42 of the tip 40, the ink flow in the tip 40 is not inhibited and it is possible to eliminate bubbles smoothly during the manufacture of the ballpoint pen 10 as the writing implement.

Moreover, in the present embodiment, when the ball 41 as the writing tip 17 is faced downward, though the valve element 57 departs from the valve seat 54*c*, it is prevented by the restricting body 58 from moving toward the outflow port 56 and stays at a position relatively near to the valve seat 54*c*. Thus, when the ball 41 as the writing tip 17 is turned from downward to upward, a time necessary for the valve element 57 to touch the valve seat 54*c* is relatively short. Therefore, the prevention of the reverse flow of the ink can be performed more effectively.

Further, the restricting body 58 can be formed in a shape other than the rectangular plate-shape unless the shape interrupts the ink flow in the valve chamber 54*b* and closes the outflow port 56.

Figure 5A:
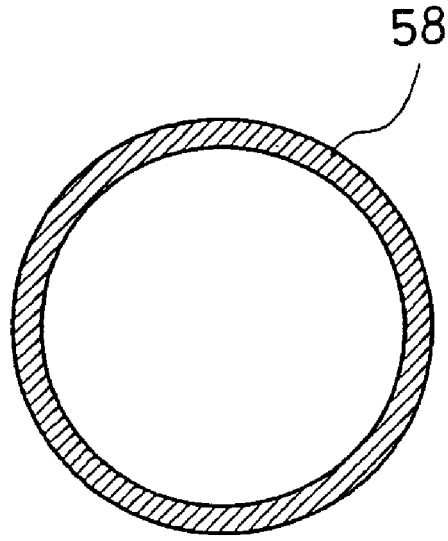
[FIG. 5] a sectional view illustrating a modified embodiment of a restricting body.
Figure 5B:
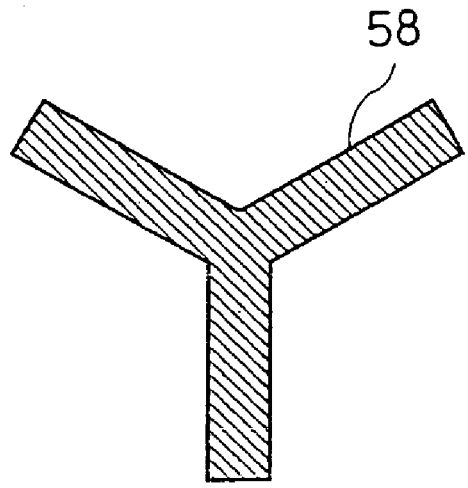
Figure 6C:
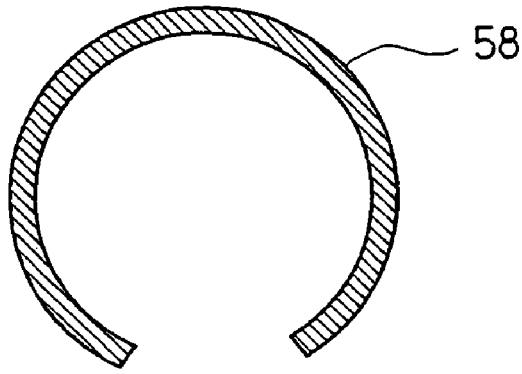
[FIG. 6] a sectional view illustrating a modified embodiment of a restricting body.
Figure 6D:
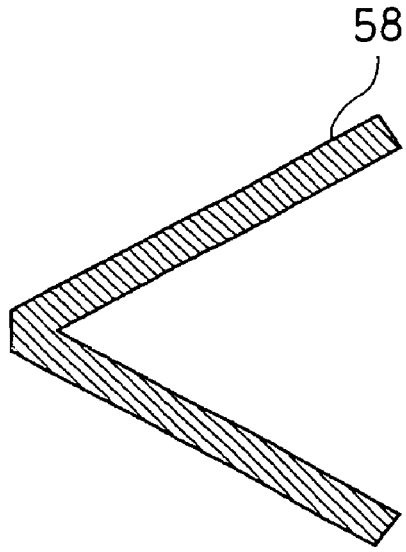
Figure 6E:
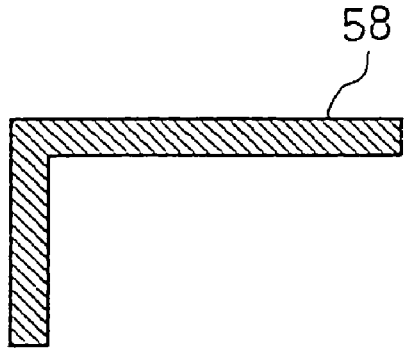
Figure 7F:
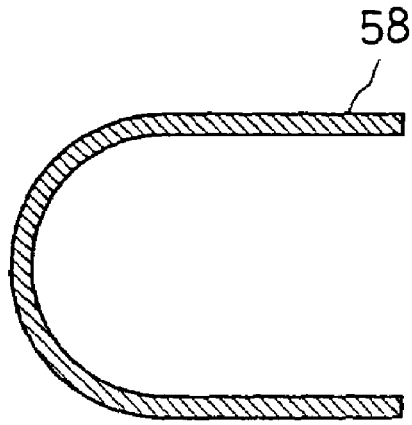
[FIG. 7] a sectional view illustrating a modified embodiment of a restricting body.
Figure 7G:
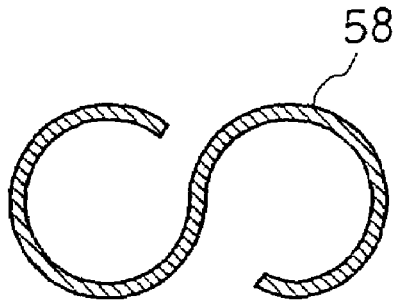
Figure 8:
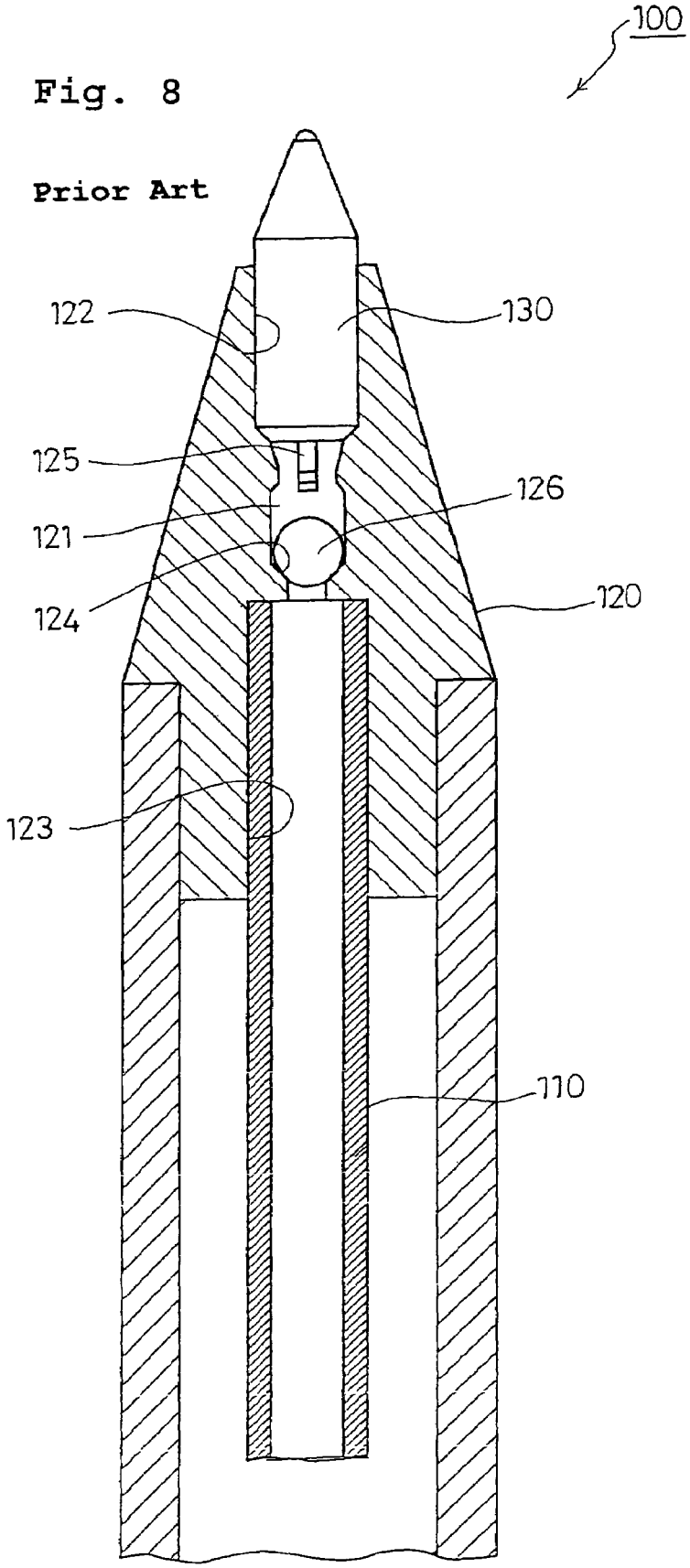
Fig. 8 Prior Art
[FIG. 8] a side sectional view of an essential part of a ballpoint pen as a conventional writing implement.
Figure 9:
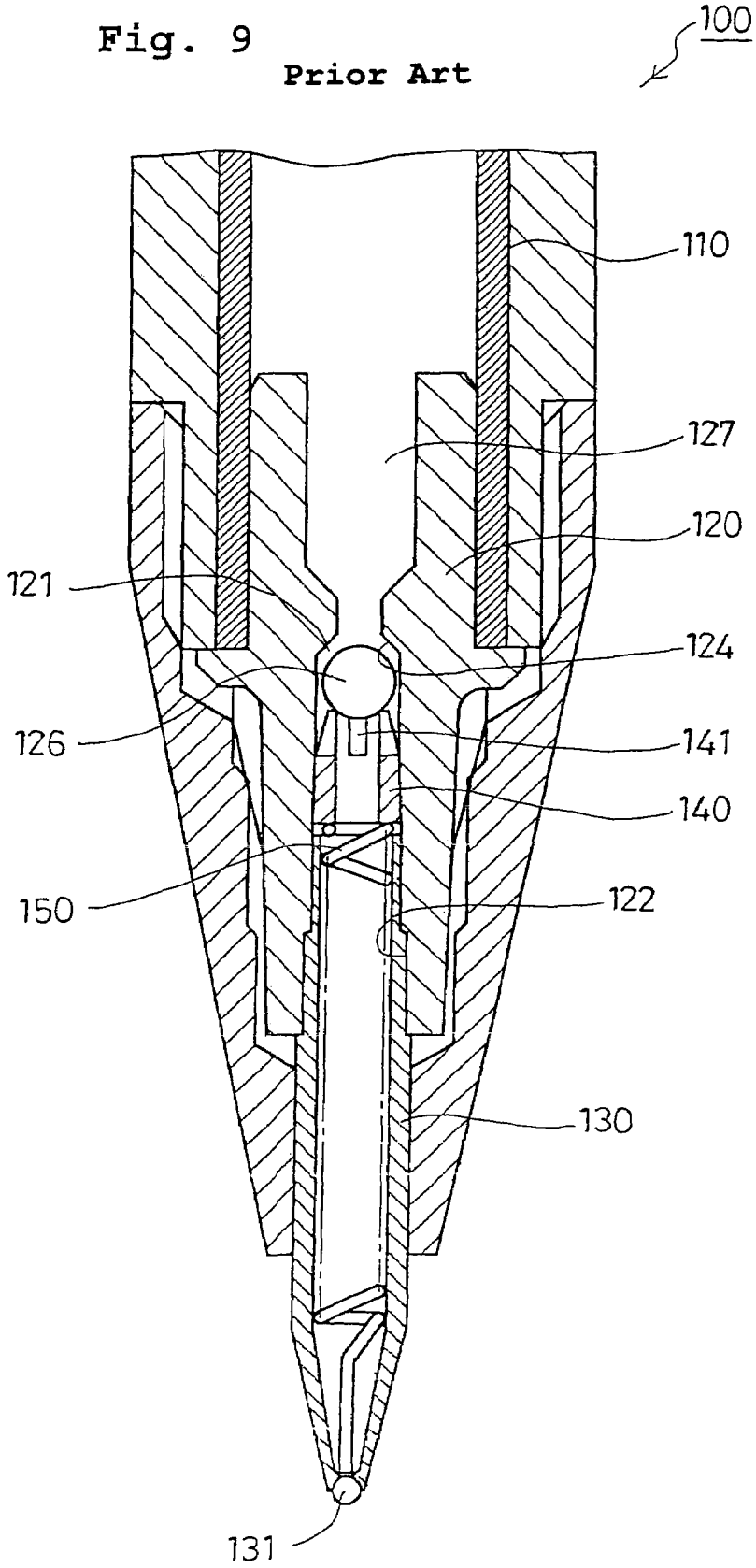
Fig. 9 Prior Art
[FIG. 9] a side sectional view of an essential part of a ballpoint pen as a conventional writing implement.

For example, as illustrated in FIG. 5(A), the restricting body 58 can be so formed that its perpendicular section to the centerline (i.e., the same sectional angle as in FIG. 4) may be ring-shaped.

Moreover, for example, as illustrated in FIGS. 5(B), 6(C), 6(D), 6(E), 7(F) or 7(G), the restricting body 58 can be so formed that its perpendicular section to the centerline may display Y-shaped, C-shaped, V-shaped, L-shaped, U-shaped or S-shaped, respectively.

INDUSTRIAL APPLICABILITY

The present invention is applicable to a writing implement with a reverse flow prevention mechanism of ink.

The invention claimed is:

1. A writing implement comprising:

an ink storage part storing ink, a writing tip applying the ink, an ink guiding hole connecting said ink storage part and said writing tip, and a reverse flow prevention mechanism provided in a midway of said ink guiding hole and preventing reverse flow of the ink;

said reverse flow prevention mechanism comprising:

a valve chamber consisting of a part of said ink guiding hole, an inflow port opened to the ink storage part side of said valve chamber and having a smaller inner diameter than that of the valve chamber, an outflow port opened to the writing tip side of said valve chamber and having a smaller inner diameter than that of the valve chamber, a valve element stored in said valve chamber and being movable in the valve chamber by its own weight, a restricting body being stored in said valve chamber at a position on the outflow port side of said valve element, being formed not to touch said writing tip, and being formed in a shape not to interrupt an ink flow in the valve chamber and not to close said outflow port, and being movable in said valve chamber by its own weight, and a valve seat provided around said inflow port;

said inflow port being closed by said valve element falling toward the inflow port by its own weight to touch said valve seat when said writing tip is faced upward;

said inflow port being opened by said valve element falling toward said outflow port by its own weight to depart from said valve seat and touching said restricting body not to reach the outflow port when said writing tip is faced downward.

* * * * *